US011426858B2

(12) United States Patent
Jiang

(10) Patent No.: US 11,426,858 B2
(45) Date of Patent: Aug. 30, 2022

(54) HIGH-CAPACITY SELF-LOCKING TOOLBOX WITH THREE OPENING MODES

(71) Applicant: JALOR INDUSTRY CO., LIMITED, Danyang (CN)

(72) Inventor: Ning Jiang, Danyang (CN)

(73) Assignee: JALOR INDUSTRY CO., LIMITED, Danyang (CN)

( * ) Notice: Subject to any disclaimer, the term of this patent is extended or adjusted under 35 U.S.C. 154(b) by 656 days.

(21) Appl. No.: 16/467,050

(22) PCT Filed: Dec. 29, 2017

(86) PCT No.: PCT/CN2017/119628
§ 371 (c)(1),
(2) Date: Jun. 6, 2019

(87) PCT Pub. No.: WO2019/119508
PCT Pub. Date: Jun. 27, 2019

(65) Prior Publication Data

US 2021/0078159 A1 Mar. 18, 2021

(30) Foreign Application Priority Data

Dec. 21, 2017 (CN) ..... 201711391082.7
Dec. 21, 2017 (CN) ..... 201721800518.9

(51) Int. Cl.
*B25H 3/02* (2006.01)
*B25H 3/00* (2006.01)
(Continued)

(52) U.S. Cl.
CPC ..... *B25H 3/022* (2013.01); *B25H 3/003* (2013.01); *B65D 21/0213* (2013.01);
(Continued)

(58) Field of Classification Search
CPC ..... B25H 3/003; B25H 3/04; B65D 25/108; B65D 25/103; B65D 25/10
(Continued)

(56) References Cited

U.S. PATENT DOCUMENTS 6,062,385 A 5/2000 Cho
7,931,143 B1 * 4/2011 Lin ..... B25H 3/021 220/629
2018/0177277 A1 * 6/2018 Dinata ..... B65D 41/04

FOREIGN PATENT DOCUMENTS

CN 201711956 U * 1/2011
CN 201711956 U 1/2011
(Continued)

*Primary Examiner* — Anthony D Stashick
*Assistant Examiner* — Symren K Sanghera
(74) *Attorney, Agent, or Firm* — Bayramoglu Law Offices LLC

(57) ABSTRACT

A high-capacity self-locking toolbox with three opening modes, which includes a box frame, a box cover, and a clamping base. The box frame includes an upper box frame and a lower box frame which are folded in the middle to make two pieces. The box cover includes an upper box cover and a lower box cover. The two box covers are respectively provided on an upper surface and a lower surface of the box frame. A reinforced rib surface is provided inside an inner wall of the box frame. The reinforced rib surface is provided with self-locking clamping members in pairs, and the clamping base is installed in the self-locking clamping members. The three opening modes enable the toolbox to be opened from the upper side, the lower side, or the middle, so as to have access to the tools from any side of the toolbox. The interior of the toolbox is designed in modular, the clamping base has a self-locking function, and the tools have a compact arrangement.

16 Claims, 7 Drawing Sheets

(51) Int. Cl.
*B65D 21/02* (2006.01)
*B65D 25/02* (2006.01)
*B65D 45/18* (2006.01)

(52) U.S. Cl.
CPC ..... *B65D 25/02* (2013.01); *B65D 45/18* (2013.01); *B65D 2251/1058* (2013.01); *B65D 2251/1083* (2013.01)

(58) Field of Classification Search
USPC ..... 206/379, 372, 373
See application file for complete search history.

(56) References Cited

FOREIGN PATENT DOCUMENTS

| | | | |
|---|---|---|---|
| CN | 202507268 | U | 10/2012 |
| CN | 203696960 | U | 7/2014 |
| CN | 107249378 | A | 10/2017 |
| DE | 202013101765 | U1 | 5/2013 |

* cited by examiner

HIGH-CAPACITY SELF-LOCKING TOOLBOX WITH THREE OPENING MODES

CROSS REFERENCE TO RELATED APPLICATIONS

This application is the national phase entry of International Application PCT/CN2017/119628, filed on Dec. 29, 2017, which is based upon and claims priority to Chinese Patent Application No. CN 201711391082.7, filed on Dec. 21, 2017, and Chinese Patent Application No. CN 201721800518.9, filed on Dec. 21, 2017, the entire contents of which are incorporated herein by reference.

TECHNICAL FIELD

The present invention belongs to the field of packaging of electric tool accessories, specifically relates to a high-capacity self-locking toolbox with three opening modes.

BACKGROUND

With the development of technology, the requirements for toolboxes has increased. The traditional plastic toolbox, folded and opened in the middle, has two pieces, which are opened toward opposite directions. Such a toolbox has a single open mode and a small storage capacity. Basically, the diameters of the tools such as drills, screw bits, and sleeves are less than or equal to 10 mm, and the thickness of a standard toolbox is 43 mm. The tool kit is packed in the toolbox, which makes it convenient for carrying tools and reduces the chance of misplacing the parts. However, with the development of technology, more and more types of tools with varied sizes are used. To pack all these tools, the size of the toolbox is increasing, and there are diverse designs, such as multi-layer toolbox and four-folded toolbox. Although these toolboxes can carry many tools or tool accessories, there still exist many drawbacks during practical use, which mainly include:

1. large toolbox size and high mold cost;
2. the incompact interior arrangement, and inefficient use of the space;
3. the multi-layer toolbox and four-folded toolbox with a thin box body have poor durability and inconvenient access to the tools;
4. internal components have poor interchangeability and universality, and cannot realize the modularization;
5. the tools packed inside the toolbox are incapable of self-locking and will become detached easily; and
6. the surface panels cannot be quickly replaced and the outlooks of the toolboxes are monotonous.

Therefore, it's imperative for the researchers to develop a novel toolbox to overcome the above drawbacks of the existing products.

SUMMARY

To solve the above problems, the present invention discloses a high-capacity self-locking toolbox with three opening modes. The three opening modes enable the toolbox to be opened from the upper side, the lower side, or the middle side, so as to have access to the tools from any side of the toolbox. The interior of the toolbox is designed in modular with a compact tool arrangement and a self-locking function. The durability of the product is increased by 50%, while the capacity of the toolbox is ensured.

To achieve the above objective, the technical solution of the present invention is as follows.

A high-capacity self-locking toolbox with three opening modes, characterized in that, it includes a box frame, a box cover, and a clamping base. The box frame includes an upper box frame and a lower box frame which are folded in the middle to make two pieces. The box cover includes an upper box cover and a lower box cover, which are respectively provided on an upper surface and a lower surface of the box frame. A reinforced rib surface is provided inside an inner wall of the box frame. The reinforced rib surface is provided with self-locking clamping members in pairs. The clamping base is installed in the self-locking clamping members.

As an improvement of the present invention, the upper box cover is connected to the box frame through first pins and the lower box cover is connected to the box frame through second pins.

As an improvement of the present invention, the upper box frame is connected to the lower box frame through third pins.

As an improvement of the present invention, the first pins, the second pins, and the third pins are provided on the same side of the box frame.

As an improvement of the present invention, the first pins, the second pins, and the third pins are provided on the different sides of the box frame.

As an improvement of the present invention, a position of the box frame opposite to the third pins is provided with an elastic locking mechanism.

As an improvement of the present invention, a joint between the upper box cover and the upper box frame is provided with an upper sliding locking mechanism, the upper sliding locking mechanism is symmetrical about the first pins.

As an improvement of the present invention, a joint between the lower box cover and the lower box frame is provided with a lower sliding locking mechanism symmetrical about the second pins.

As an improvement of the present invention, the reinforced rib surface inside the upper box frame and the lower box frame is provided with self-locking clamping members with a longitudinal symmetry.

As an improvement of the present invention, 2-6 sets of the self-locking clamping members are provided.

As an improvement of the present invention, each set of the self-locking clamping members includes a fixing member, a rotating member, and a pair of limiting protrusions. The rotating member is provided at one side of the fixing member, and the pair of limiting protrusions are provided at the other side of the fixing member. The fixing member and the rotating member recessed inward are provided on the reinforced rib surface. The pair of limiting protrusions protruded outward are provided on the reinforced rib surface.

As an improvement of the present invention, the fixing member is a vertical T-shaped groove.

As an improvement of the present invention, the rotating member is vertically U-shaped and an interior of the rotating member has a stepped shape.

As an improvement of the present invention, the clamping base includes a first base body and a horizontal stopper block. A lower part of each of the two ends of the first base body is provided with a first connector. An upper part of each of the two ends of the first base body is provided with a limiting block. The first base body is provided with a plurality of blind holes. An inner side of the first base body is provided with limiting holes. A surface of the horizontal stopper block is provided with limiting clamps. Two ends of the horizontal stopper block are provided with T-shaped blocks. The T-shaped blocks are inserted into the fixing members. The first connector is inserted into the rotating member. The limiting clamps are inserted into the limiting holes, and the limiting blocks are clamped in the limiting protrusions.

As an improvement of the present invention, the blind holes of the first base body are hexagon-shaped.

As an improvement of the present invention, the clamping base includes two parts, namely, a second base body and a protective board. A lower part of each of the two ends of the second base body is provided with a second connector. An inner side of the second connector is provided with a connection clamping position. An upper part of each of the two ends of the second base body is provided with a limiting block. The second base body is provided with a plurality of blind holes. The protective board includes a front stopper board, a support beam, a self-locking head, and an anti-collision protrusion. The anti-collision protrusion is provided at a front end of the front stopper board. The self-locking head is a circular plastic clamp with an end gap. The second connector is inserted into the rotating member. The self-locking head is inserted into the connection clamping position. The support beam is provided under the second base body, and the front stopper board is provided at a front end of the second base body.

As an improvement of the present invention, the blind holes of the second base body are hexagon-shaped.

As an improvement of the present invention, ribs are provided between the inner wall of the box frame and the reinforced rib surface.

As an improvement of the present invention, the first base body and the second base body are each provided with a V-shaped groove on a surface.

The advantages of the present invention are as below.

The high-capacity self-locking toolbox with three opening modes is novel in structure and handy. The three opening modes enable the toolbox to be opened from the upper side, the lower side, or the middle, so as to have access to the tools from any side of the toolbox. The interior of the toolbox is designed in modular, the clamping base has a self-locking function, and the tools have a compact arrangement. The product durability is increased by 50%, while a high capacity is ensured.

Figure 1:
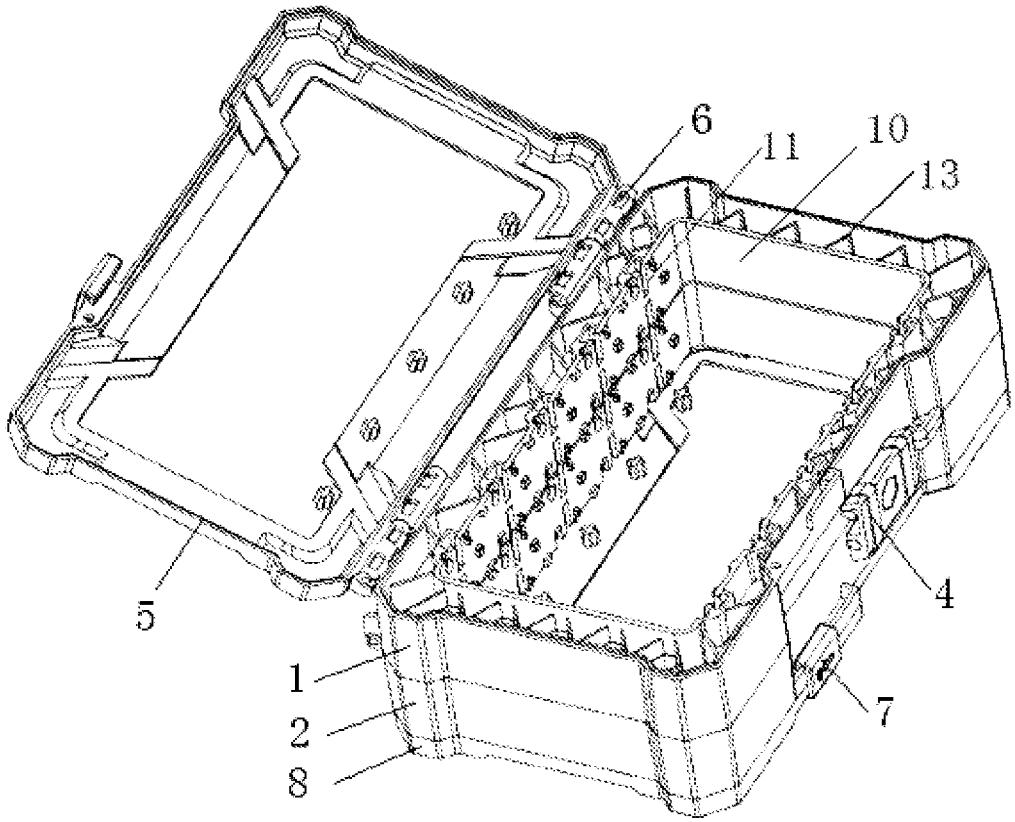
FIG. 1 is a structural schematic diagram of a toolbox open with an opened upper box cover of the present invention (without tools)

The reference designators in the drawings are described below: 1. upper box frame, 2. lower box frame, 3. third pin, 4. plastic locking mechanism, 5. upper box cover, 6. first pin, 7. lower sliding locking mechanism, 8. lower box cover, 9. second pin, 10. reinforced rib surface, 11. self-locking clamping member, 12. clamping base, 13. rib, 14. rotating member, 15. fixing member, 16. limiting protrusion, 17. self-locking clamping base, 18. front stopper clamping base, 19. first base body, 20. horizontal stopper block, 21. first connector, 22. limiting block, 23. blind hole, 24. limiting hole, 25. limiting clamp, 26. T-shaped block, 27. tool, 28. second base body, 29. protective board, 30. second connector, 31. connection clamping position, 32. second limiting block, 33. front stopper board, 34. support beam, 35. self-locking head, 36. anti-collision protrusion, 37. V-shaped groove, 38. ball groove, 39. upper sliding locking mechanism.

DETAILED DESCRIPTION OF THE EMBODIMENTS

The present invention will be described in detail hereinafter with reference to the drawings and the embodiments of the present invention. It should be understood that the embodiments below are merely intended to explain the present invention, rather than limit the scope of the present invention. It should be noted that the terms used in the following description, such as "front", "back", "left", "right", "upper" and "lower" refer to the directions shown in the drawings. The terms such as "inner" and "outer" respectively refer to a direction towards or away from the geometrical centers of specific components.

Figure 2:
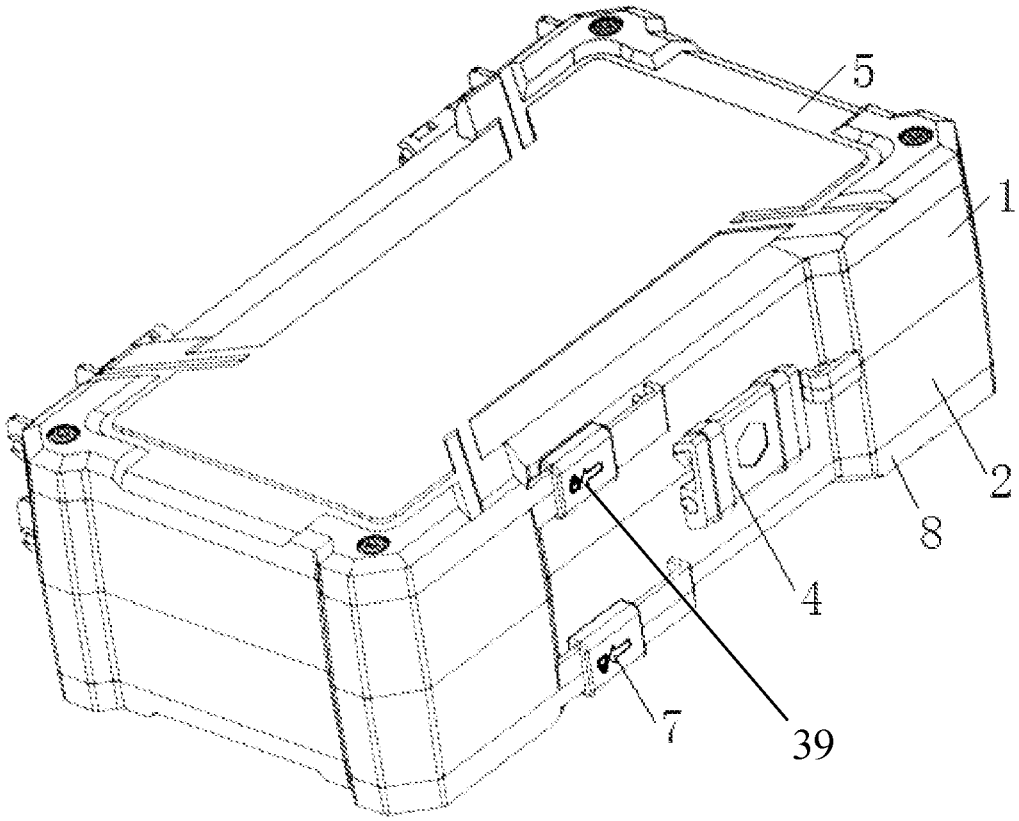
FIG. 2 is a schematic diagram showing the front side of the toolbox of the present invention.
Figure 3:
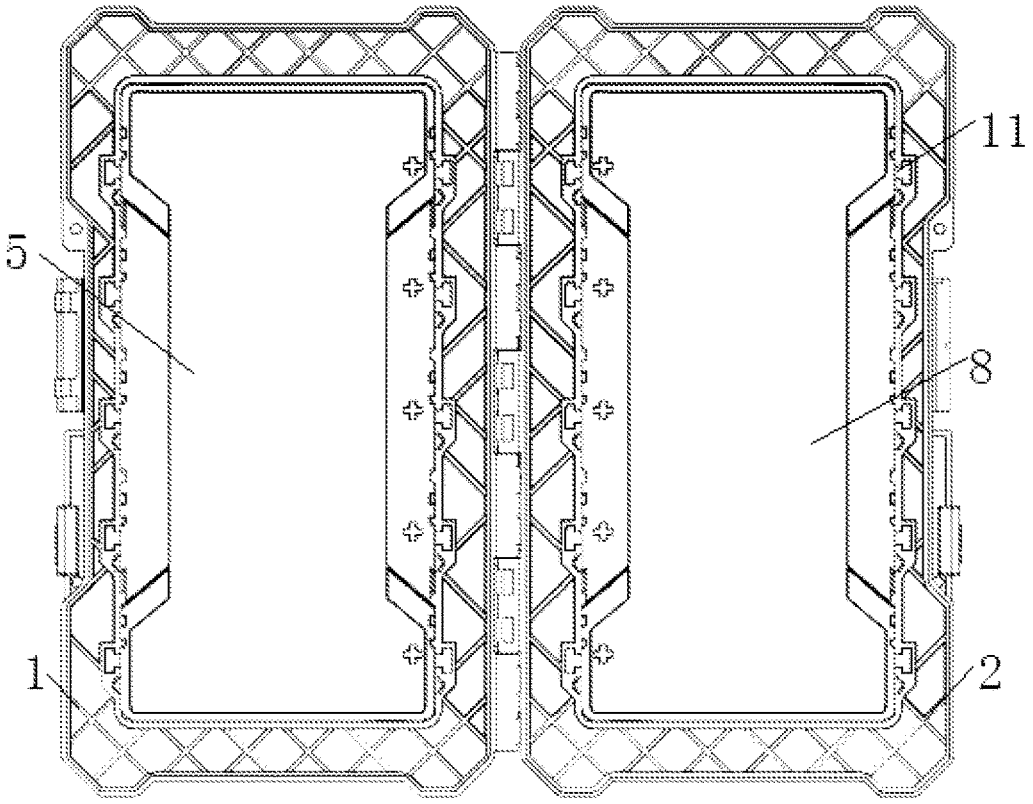
FIG. 3 is a schematic diagram showing that an upper box frame and a lower box frame of the toolbox of the present invention are opened (without tools)
Figure 4:
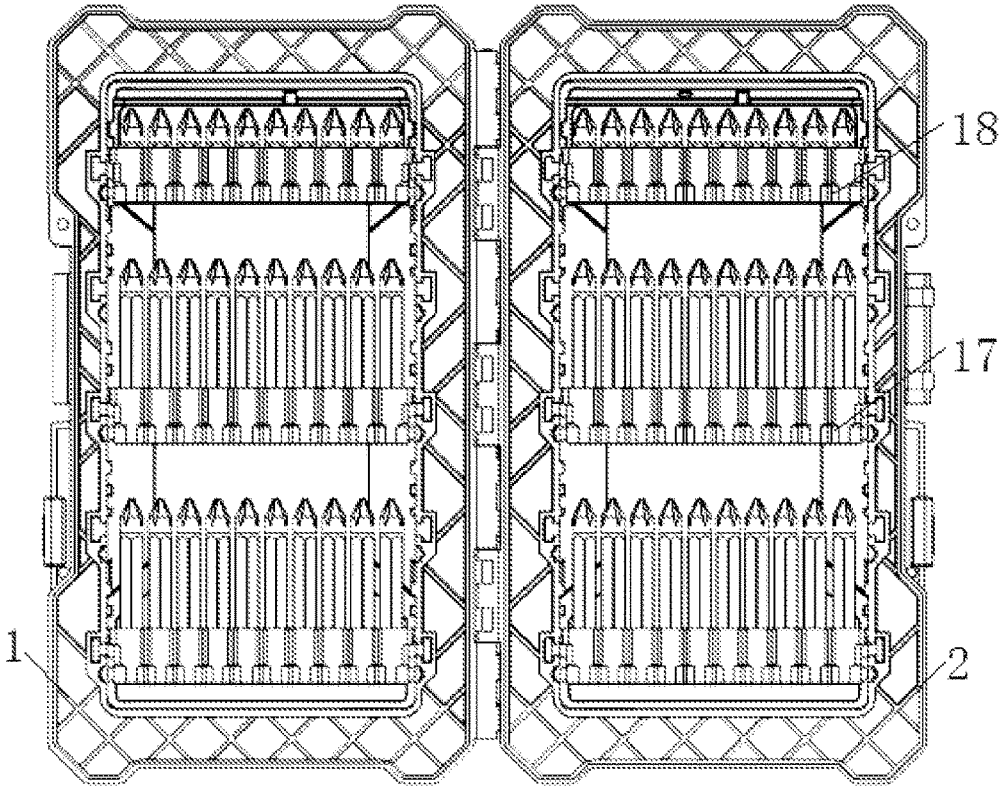
FIG. 4 is a schematic diagram showing that an upper box frame and a lower box frame of the toolbox of the present invention are opened (with tools)
Figure 13:
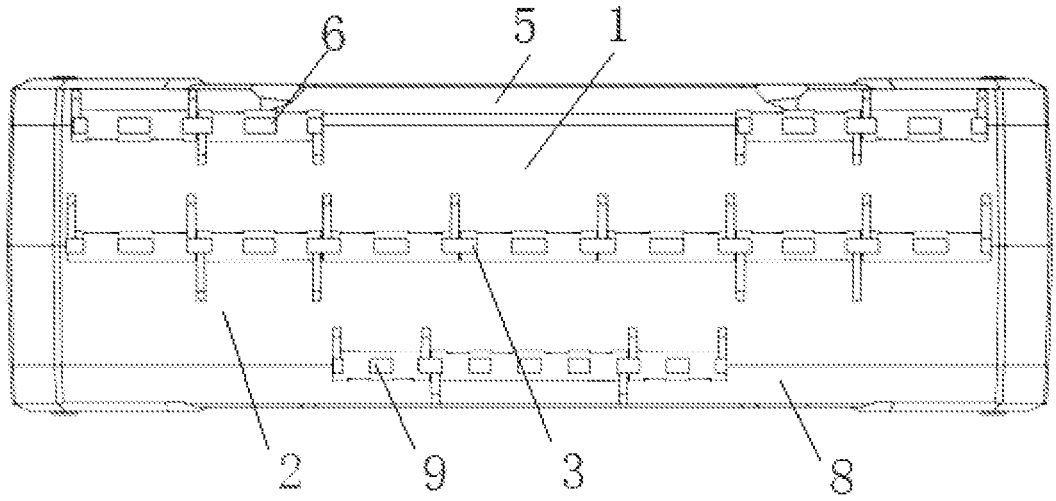
FIG. 13 is a schematic diagram of a back side of the toolbox of the present invention.

As shown in FIG. 1, FIG. 2 and FIG. 13, a high-capacity self-locking toolbox with three opening modes of the present invention is made of an ABS material. The main body of the toolbox is a rectangular box frame including the upper box frame 1 and the lower box frame 2. The upper box frame 1 and the lower box frame 2 can be folded and opened in the middle. The back ends of the upper box frame 1 and the lower box frame 2 are connected to each other through the third pins 3. The front ends of the upper box frame 1 and the lower box frame 2 are provided with the elastic locking mechanism 4 which is closed when the toolbox is not in use. The upper part of the upper box frame 1 is provided with the upper box cover 5. The upper surface of the upper box frame 1 is connected to one side of the upper box cover 5 through the first pins 6, and the opposite side of the upper box cover 5 is locked or opened through the upper sliding locking mechanism 39. The lower part of the lower box frame 2 is provided with the lower box cover 8. The lower surface of the lower box frame 2 is connected to one side of the lower box cover 8 through the second pins 9, and the opposite side of the lower box cover 8 is locked or opened through the lower sliding locking mechanism 7. The two box covers are provided on the upper surface and the lower surface of the box frame, respectively. The upper box cover 5 and the lower box cover 8 may be replaced as needed and have diverse designs, so the development cost of the molds can be reduced.

FIG. 1, FIG. 3, FIG. 5, FIG. 6, and FIG. 10 show the high-capacity self-locking toolbox with three opening modes of the present invention. The reinforced rib surfaces 10 are provided inside the inner wall of the upper box frame 1 and the lower box frame 2, i.e., the toolbox includes two layers, and the reinforced rib surface is an inner layer of the toolbox. Taking, for instance, the upper box frame 1, the reinforced rib surfaces 10 at the front side are provided with 2-6 pairs of self-locking clamping members 11, and the reinforced rib surfaces 10 at the back side are also provided with 2-6 pairs of self-locking clamping members. The clamping base 12 may be installed in any one of the self-locking clamping members at the front side or the back side. The tools 27 such as drills, screw bits, and sleeves, etc. are placed in the clamping base 12. The lower box frame 2 and the upper box frame 1 have an identical structure, which means that the lower box frame and the upper box frame are both designed to have double layers. In other words, the toolbox can pack the tools in 4 layers and the tools can be taken out by opening the upper box cover or the lower box cover, respectively. Therefore, the capacity of a box body is increased and more tools can be packed in the toolbox. Moreover, the toolbox has a compact interior structure, which can reduce the overall size of the toolbox.

Figure 6:
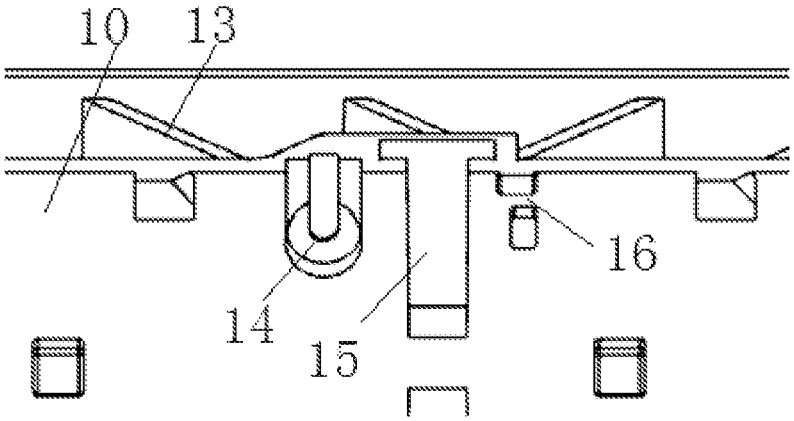
FIG. 6 is a front view of the self-locking clamping member of the present invention.
Figure 7:
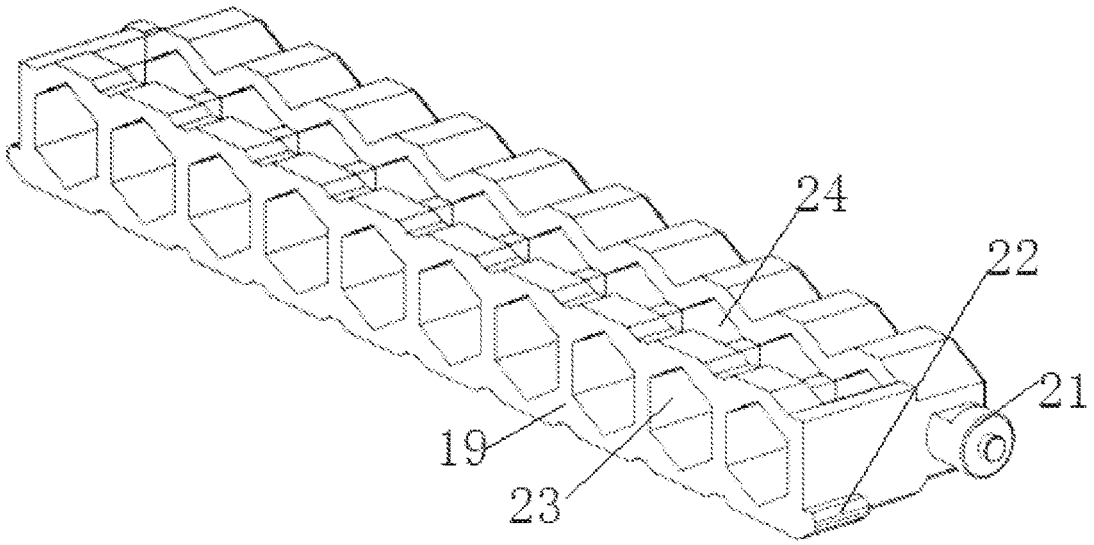
FIG. 7 is a schematic diagram of a first base body of the present invention.

As shown in FIG. 1 and FIG. 6, according to the high-capacity self-locking toolbox with three opening modes of the present invention, the reinforcing ribs 13 are provided between the inner walls of the upper box frame 1 and the lower box frame 2 and the reinforced rib surface 10 to improve the durability of the box body and prolong the service life.

Figure 5:
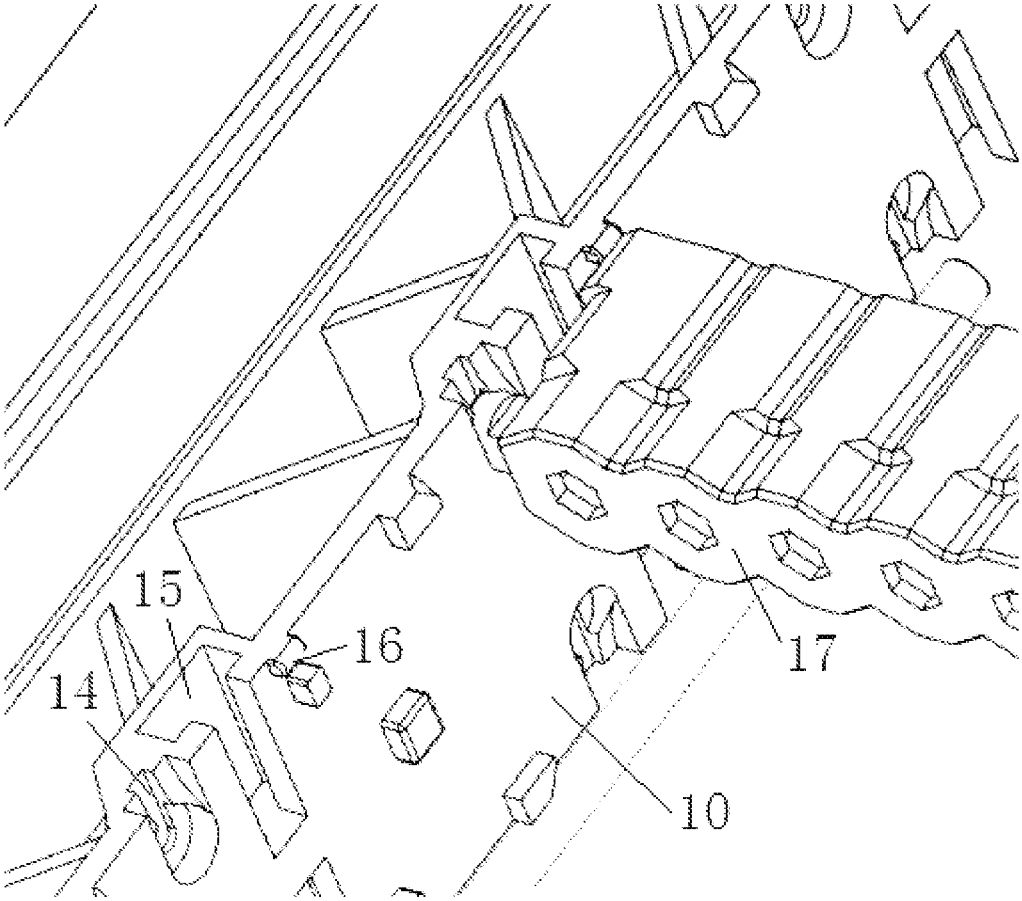
FIG. 5 is a schematic diagram of the self-locking clamping member of the present invention.
Figure 8:
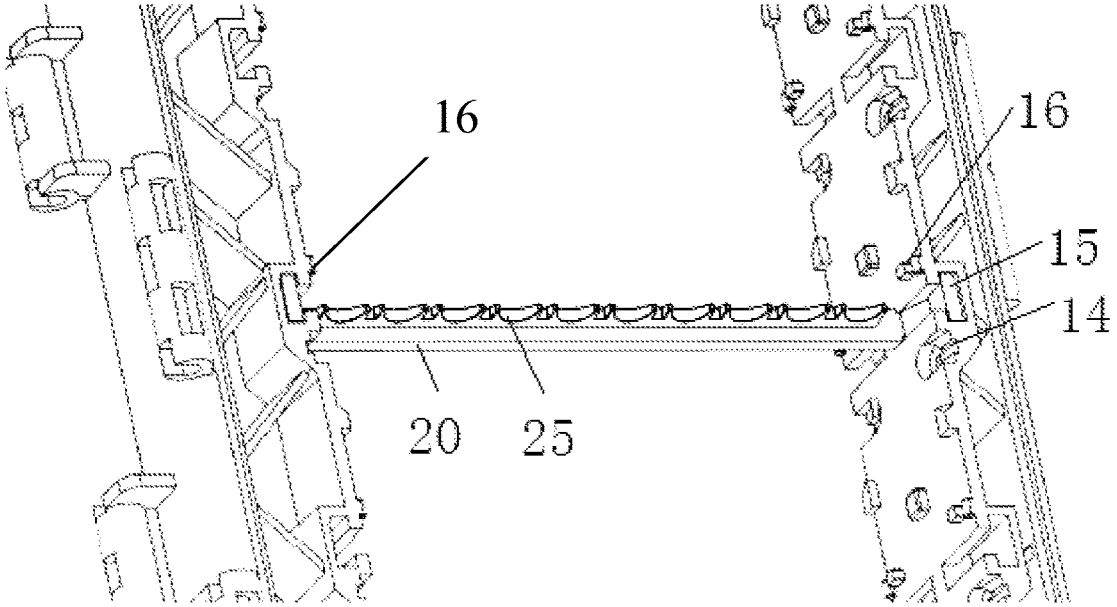
FIG. 8 is a schematic diagram showing a connection of a horizontal stopper block and a box body of the present invention.
Figure 9:
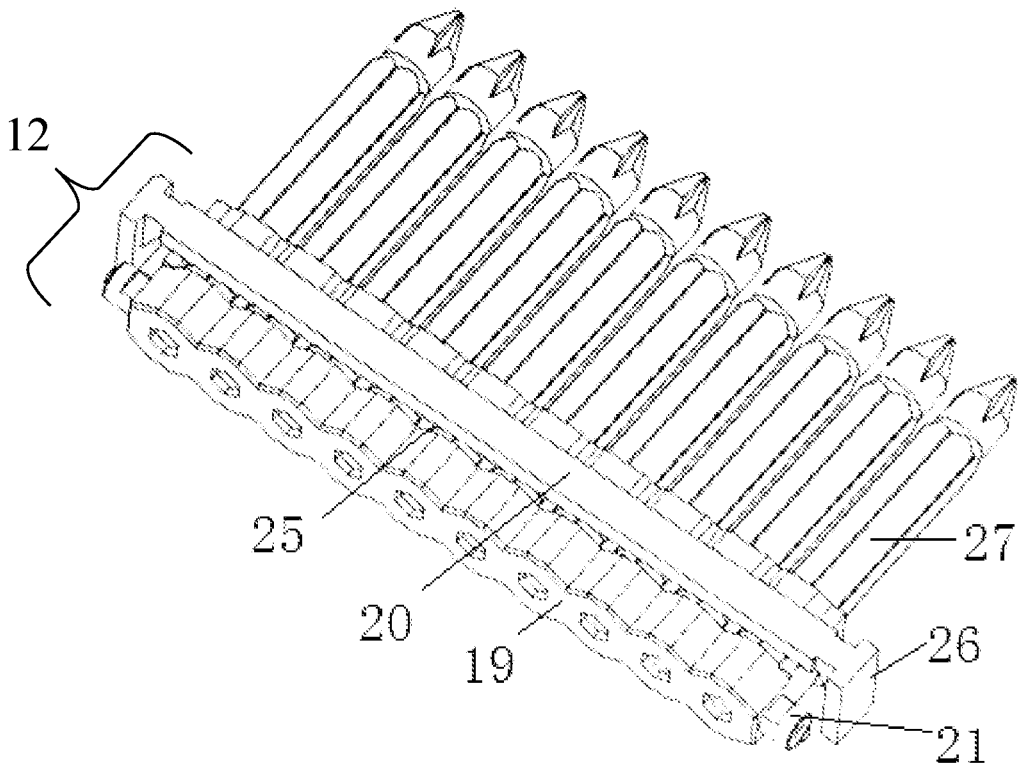
FIG. 9 is a schematic diagram showing a connection of a first box body and a horizontal stopper block of the present invention.
Figure 10:
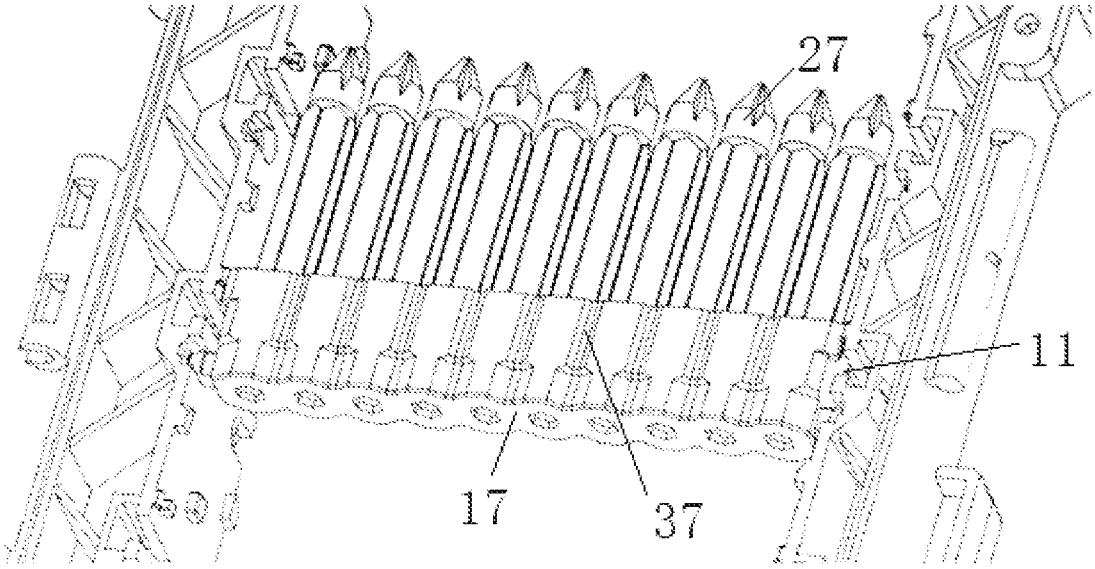
FIG. 10 is a schematic diagram showing a connection of a self-locking clamping base and a self-locking clamping member of the present invention.
Figure 11:
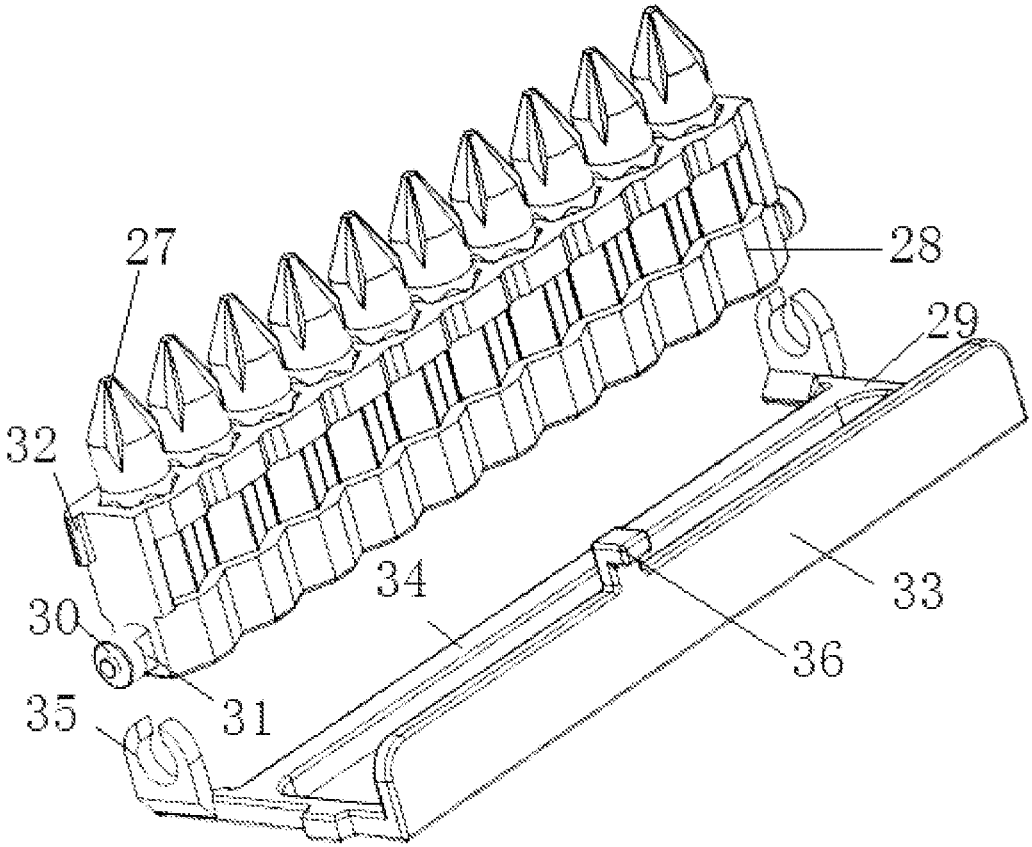
FIG. 11 is a structural schematic diagram of a front stopper clamping base of the present invention.
Figure 12:
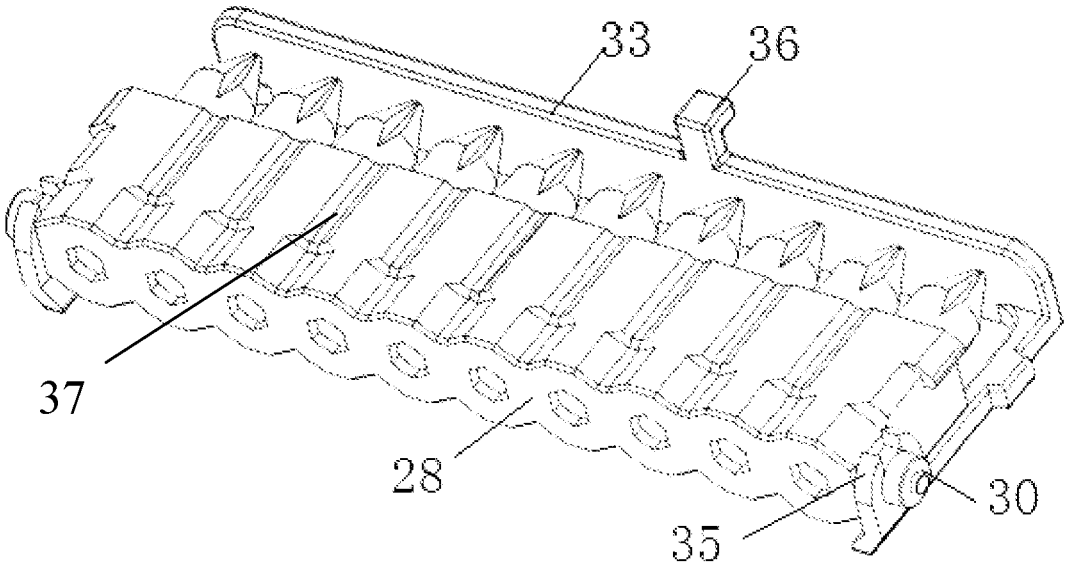
FIG. 12 is a schematic diagram showing a connection of a clamping base with a front stopper board of the present invention.

As shown in FIG. 5, FIG. 6, and FIG. 8, according to the high-capacity self-locking toolbox with three opening modes of the present invention, each self-locking clamping member 11 includes the fixing member 15, the rotating member 14, and two limiting protrusions 16. The fixing member 15 is in the middle. The rotating member 14 is provided at one side of the fixing member 15, and the limiting protrusions 16 are provided at another side of the fixing member 15. The fixing member 15 and the rotating member 14 recessed inward are provided on the reinforced rib surface 10. The limiting protrusions 16 protruded outwards are provided on the reinforced rib surface 10.

The fixing member 15 is a vertical T-shaped groove or the grooves of any other shape capable of clamping components. The rotating member 14 is vertically U-shaped, and an interior of the rotating member 14 has a stepped shape as shown in FIG. 5.

According to the high-capacity self-locking toolbox with three opening modes of the present invention, the clamping bases 12 of two types are clamped in the self-locking clamping members 11. The two types of clamping bases 12 are described below.

Figure 14:
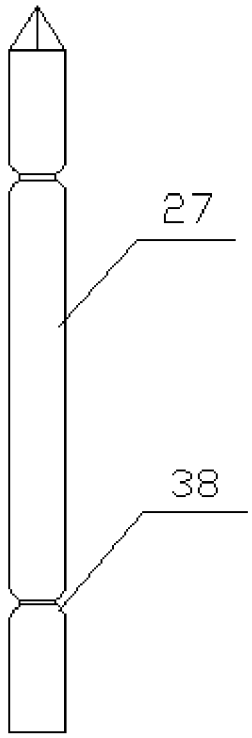
FIG. 14 is a schematic diagram of a tool of the present invention.

The self-locking clamping base 17: the main role of the self-locking clamping base 17 is to clamp the tools 27 such as screw bit with a ball groove 38 and sleeve etc. (the ball groove is located in a thinner waist at the side of the screw bit). For example, the 50 MM screw bit is provided with an R-shaped groove at the side end. As shown in FIG. 14, the self-locking clamping base 17 includes two parts, i.e., the first base body 19 and the horizontal stopper block 20. A lower part of each of the two ends of the first base body 19 is provided with the first connector 21. An upper part of each of the two ends of the first base body 19 is provided with the limiting blocks 22. The first base body is provided with a plurality of blind holes 23 where the tools 27 are placed into. An inner side surface of the first base body 19 is provided with the limiting hole 24. One end of the tool is put into the blind hole 23. The R-shaped groove of the ball groove of the screw bit is exposed to the outside at the limiting hole 24. The surface of the horizontal stopper block 20 is provided the limiting clamp 25. Two ends of the horizontal stopper block 20 are provided with the T-shaped blocks 26. The T-shaped blocks 26 are inserted into the fixing member 15 of the self-locking clamping member. The first connector 21 is inserted into the rotating member 14 of the self-locking clamping member. The first base body 19 is capable of rotating. When the first base body 19 is flatwise, the limiting clamp 25 is exactly inserted into the limiting hole 24 to clamp the tools with the R-shaped groove. Meanwhile, the limiting block 22 is clamped between a pair of limiting protrusions 16 (when the first base body is about to become flatwise, when there is a 1 mm distance between the limiting blocks and the limiting protrusions before intersection, since the box body is made of the ABS material with a certain elasticity, it takes a bit of force to compress the limiting blocks 22 at two ends of the first base body in the position between the pair of the limiting protrusions). Thereby, the clamp base is locked, and the toolbox can be carried with the tools in a safe and ordered condition. Besides, the horizontal stopper block supports the reinforced rib surface 10 on two sides to further strengthen the box.

The front stopper clamping base 18; the front stopper clamping base 18 is used to pack the tools without the ball groove. The front stopper clamping base includes the second base body 28 and the protective board 29. A lower part of each of the two ends of the second base body 28 is provided with the second connector 30. An inner side of the second connector is provided with the connection clamping position 31. An upper part of each of the two ends of the second base body 28 is provided with the second limiting block 32. The second base body 28 is provided with a plurality of blind holes. The tail ends of the tools 27 are put into the blind holes. The protective board 29 includes the front stopper board 33, the support beam 34, the self-locking head 35, and the anti-collision protrusion 36. The anti-collision protrusion 36 is provided at a front end of the front stopper board 33. The self-locking head 35 is a circular elastic clamp with an end gap. The second connector 30 is inserted into the rotating member 14. The self-locking head 35 is inserted into the connection clamping position 31. The support beam 34 is provided under the second base body 28. The front stopper board 33 is provided at a front end of the second base body 28. The second limiting block 32 is clamped between a pair of the limiting protrusions 16. During use, the second base body 28 seizes the tools and the front stopper board 29 directly shields the tools. There are two key points of the design: 1. The self-locking heads 35 are the circular elastic clamps with end gaps, and the self-locking heads 35 are inserted into the connection clamping positions 31 provided at two ends of the second base body. The self-locking heads are designed as a U shape with an O shape, and have elasticity and self-locking function. Besides, the front stopper board 33 is provided with the anti-collision protrusion 36 for grabbing the product, conveniently. Moreover, the anti-collision protrusions of different clamping bases are staggered to avoid interference among the clamping bases.

The first base body 19 and the second base body 28 are provided with the V-shaped grooves 37 on the surfaces, which creates an elegant appearance and reduces the weight of the clamping bases.

According to the present invention, the self-locking clamping bases and the front stopper clamping bases are fixed in the self-locking clamping members of the upper box frame and the lower box frame, and there are many combinations of positions and numbers, and the users can choose any one of them as needed, so the product has diverse uses, and such a modular design is beneficial for the development of the products in the future. Therefore, the development cost of the later new products can be reduced.

The technical means disclosed by the present technical solution are not limited to the technical means disclosed by the above embodiments, it further includes the technical solutions of any combination of the above technical features.

What is claimed is:

1. A high-capacity self-locking toolbox with three opening modes comprising a box frame, a box cover, and a clamping base, wherein the box frame comprises an upper box frame and a lower box frame, the upper box frame and a lower box frame are folded in the middle to make two pieces; the box cover comprises an upper box cover and a lower box cover, the upper box cover and the lower box cover are respectively provided on an upper surface and a lower surface of the box frame, wherein a reinforced rib surface is provided inside an inner wall of the box frame, the reinforced rib surface is provided with self-locking clamping members in pairs; and the clamping base is installed in the self-locking clamping members, wherein the reinforced rib surface inside the inner wall of box frame is provided with a plurality of self-locking clamping members with a longitudinal symmetry, wherein each set of the plurality of self-locking clamping members comprises a fixing member, a rotating member, and a pair of limiting protrusions; the rotating member is provided at a first side of the fixing member, and the pair of limiting protrusions are provided at a second side of the fixing member; the fixing member and the rotating member recessed inward are provided on the reinforced rib surface; and the pair of limiting protrusions protruded outward are provided on the reinforced rib surface.

2. The high-capacity self-locking toolbox with three opening modes according to claim 1, wherein the upper box cover is connected to the box frame through a plurality of first pins, the lower box cover is connected to the box frame through a plurality of second pins, and the upper box frame is connected to the lower box frame through a plurality of third pins.

3. The high-capacity self-locking toolbox with three opening modes according to claim 2, wherein the plurality of first pins, the plurality of second pins, and the plurality of third pins are provided on a same side of the box frame.

4. The high-capacity self-locking toolbox with three opening modes according to claim 2, wherein a position of the box frame opposite to the plurality of third pins is provided with an elastic locking mechanism.

5. The high-capacity self-locking toolbox with three opening modes according to claim 2, wherein a joint between the upper box cover and the upper box frame is provided with an upper sliding locking mechanism, and the upper sliding locking mechanism is symmetrical about the plurality of first pins.

6. The high-capacity self-locking toolbox with three opening modes according to claim 2, wherein a joint between the lower box cover and the lower box frame is provided with a lower sliding locking mechanism, and the lower sliding locking mechanism is symmetrical about the plurality of second pins.

7. The high-capacity self-locking toolbox with three opening modes according to claim 1, wherein 2-6 sets of the plurality of self-locking clamping members are provided.

8. The high-capacity self-locking toolbox with three opening modes according to claim 1, wherein the fixing member is a vertical T-shaped groove.

9. The high-capacity self-locking toolbox with three opening modes according to claim 1, wherein the rotating member is vertically U-shaped and an interior of the rotating member has a stepped shape.

10. The high-capacity self-locking toolbox with three opening modes according to claim 1, wherein the clamping base comprises a first base body and a horizontal stopper block, a lower part of each of two ends of the first base body is provided with a first connector, an upper part of each of the two ends of the first base body is provided with a limiting block, the first base body is provided with a plurality of blind holes, an inner side of the first base body is provided with a plurality of limiting holes, a surface of the horizontal stopper block is provided with a plurality of limiting clamps, each of two ends of the horizontal stopper block are provided with a T-shaped block, the T-shaped block is inserted into the fixing member, the first connector is inserted into the rotating member, the plurality of limiting clamps are inserted into the plurality of limiting holes, and the limiting blocks are clamped in the limiting protrusions.

11. The high-capacity self-locking toolbox with three opening modes according to claim 10, wherein the plurality of blind holes of the first base body are hexagon-shaped.

12. The high-capacity self-locking toolbox with three opening modes according to claim 1, wherein the clamping base comprises a second base body and a protective board, a lower part of each of two ends of the second base body is provided with a second connector, an inner side of the second connector is provided with a connection clamping position, an upper part of each of the two ends of the second base body is provided with a limiting block, and the second base body is provided with a plurality of blind holes; the protective board comprises a front stopper board, a support beam, a self-locking head, and an anti-collision protrusion, the anti-collision protrusion is provided at a front end of the front stopper board, the self-locking head is a circular plastic clamp with an end gap, the second connector is inserted into the rotating member, the self-locking head is inserted into the connection clamping position, the support beam is provided under the second base body, and the front stopper board is provided at a front end of the second base body.

13. The high-capacity self-locking toolbox with three opening modes according to claim 12, wherein the plurality of blind holes of the second base body are hexagon-shaped.

14. The high-capacity self-locking toolbox with three opening modes according to claim 10, wherein the first base body and a second base body are each provided with a V-shaped groove on a surface.

15. The high-capacity self-locking toolbox with three opening modes according to claim 1, wherein a plurality of ribs are provided between the inner wall of the box frame and the reinforced rib surface.

16. The high-capacity self-locking toolbox with three opening modes according to claim 11, wherein the first base body and the second base body are each provided with a V-shaped groove on a surface.

* * * * *